US005224448A

United States Patent [19]

Kandler

[11] Patent Number: 5,224,448

[45] Date of Patent: Jul. 6, 1993

[54] IGNITION BRAKE FOR AN INTERNAL COMBUSTION ENGINE

[75] Inventor: William C. Kandler, New Holstein, Wis.

[73] Assignee: Tecumseh Products Company, Tecumseh, Mich.

[21] Appl. No.: 956,397

[22] Filed: Oct. 5, 1992

Related U.S. Application Data

[63] Continuation-in-part of Ser. No. 878,175, May 4, 1992, abandoned.

[51] Int. Cl.[5] ..... F02B 77/00

[52] U.S. Cl. ..... 123/198 D; 123/149 C

[58] Field of Search ..... 123/149 C, 198 D

[56] References Cited

U.S. PATENT DOCUMENTS

| | | | |
|---|---|---|---|
| Re. 27,477 | 9/1972 | Piteo | 123/148 E |
| 3,023,870 | 3/1962 | Udelman | 192/3 |
| 3,062,930 | 11/1962 | Raleigh | 200/31 |
| 3,173,055 | 3/1965 | Harkness | 315/55 |
| 3,447,521 | 6/1969 | Piteo | 123/148 E |
| 4,079,721 | 3/1978 | Brown | 123/198 DC |
| 4,194,485 | 3/1980 | Stephenson | 123/198 DC |
| 4,204,384 | 5/1980 | Holtermann | 56/10.5 |
| 4,658,774 | 4/1987 | Kashima | 123/169 E |
| 4,712,521 | 12/1987 | Campen | 123/149 C |
| 4,809,661 | 3/1989 | Kinoshita | 123/418 |
| 4,889,213 | 12/1989 | Roller | 192/1.44 |
| 4,979,596 | 12/1990 | Roller | 188/166 |

*Primary Examiner*—Noah P. Kamen
*Attorney, Agent, or Firm*—Baker & Daniels

[57] ABSTRACT

A safety device for a single cylinder internal combustion engine powered implement includes a solid state ignition circuit for producing a spark in a spark plug. The ignition circuit includes a first coil for generating a normally timed sparking voltage in the circuit for normal engine operation, and a second coil for generating an advanced timed sparking voltage in the circuit for stopping the engine. The first and second coils are each disposed about the periphery of the flywheel and angularly displaced from each other. A deadman control having a first and second position, selectively decouples one of the coils from the ignition circuit depending on the state of position of the deadman control.

14 Claims, 5 Drawing Sheets

IGNITION BRAKE FOR AN INTERNAL COMBUSTION ENGINE

CROSS-REFERENCE TO RELATED APPLICATIONS

This is a continuation-in-part of co-pending application Ser. No. 07/878,175 filed May 4, 1992 now abandoned entitled "IGNITION BRAKE FOR INTERNAL COMBUSTION ENGINE" by the present inventor.

BACKGROUND OF THE INVENTION

1. Field of the Invention

The present invention relates to single cylinder internal combustion engines and, more particularly, to a safety device for single cylinder internal combustion engines whereby the engine is stopped within a predetermined time period.

2. Description of the Prior Art

Single cylinder internal combustion engines are generally utilized in most walk-behind lawn mowers. In these lawn mowers, the single cylinder internal combustion engine includes a flywheel disposed on one end of a crankshaft along with a blade disposed on the end opposite the flywheel. The lawn mower has a cover or deck disposed between the blade and the engine with the crankshaft extending therethrough. The cover surrounds the rotating blade keeping grass and debris from spewing out in all directions. A discharge opening located in one side lets the grass and debris exit onto the lawn or into a grass catching bag. Within the cover, the blade is rotated at a high velocity by the crankshaft in order to effect efficient cutting of the grass. Because of the high velocity at which the blade is rotating, as well as the sharpness of the blade, a lawn mower, like all power tools and machines, has an inherent potential for risk.

Because of this, safety standards have been promulgated which require that the engine, and thus the rotating blade, stop when the operator is not using the lawn mower, steps away from, or tries to leave the mower unattended. Such devices for stopping the engine when the operator is not utilizing the lawn mower or in attendance, have come to be known as "deadman" controls. These deadman controls typically consist of two parts, a positive braking mechanism disposed within the engine, and a lever disposed at the upper handle portion connected by a cable to the braking mechanism for actuating the same. The deadman lever is normally biased into a position such that the engine will not start until the operator positively moves or biases the lever opposite the normal biased position. Opposite biasing is accomplished when the operator holds the lever against the upper handle while pushing the lawn mower. In order to keep the engine running, the deadman lever must remain biased by the operator. Once the lever is released, the natural bias of the system actuates the braking mechanism and the engine stops.

In some prior art systems, the positive braking mechanism is accomplished by a flywheel brake. The flywheel brake consists of a brake shoe with a pad normally positively biased against the rim of the flywheel, either the outside or inside, to stop the flywheel by biased friction when the deadman lever is released. By stopping the flywheel, the crankshaft and associated piston also stop thereby stopping the engine altogether.

Such systems are described in U.S. Pat. Nos. 4,889,213 issued Dec. 26, 1989, entitled "Compliance Brake For An Internal Combustion Engine Powered Implement," and 4,979,596 issued Dec. 25, 1990, entitled "Safety Brake For An Engine," by inventor Lee E. Roller, both of which are specifically incorporated herein by reference.

In addition to or separate from the flywheel brake mechanism, prior art systems ground or short out the primary coil of the ignition transformer so that no current will flow into the primary coil.

Also known in the prior art are exhaust retard mechanisms that work in conjunction with the engine piston in the combustion chamber. One such system is a "Jake" brake that utilizes the pressure in the combustion chamber to slow the engine. It is believed that camshaft timing is varied in order to increase the pumping action as the exhaust leaves the cylinders, thus increasing the retarding force on the pistons and connected mechanisms. U.S. Pat. No. 3,023,870 Udelman issued Mar. 6, 1962, teaches an auxiliary brake which includes a manually operated ignition device so the engine acts as a brake. The point of ignition is advanced, thus opening the exhaust valve when the piston is three-quarters on its compression stroke.

It is an object of the present invention to provide a more reliable and efficient engine brake safety device.

SUMMARY OF THE INVENTION

The present invention provides a safety device for a single cylinder internal combustion engine powered implement which, upon actuation of a deadman lever, advances the normal timing of a spark generating voltage such that a premature spark is produced in the combustion chamber of the engine cylinder. The premature spark produces a premature pressure rise in the combustion chamber forcing the piston downward against the inertia of the engine crankshaft to thereby stop the engine.

In one form thereof, the safety device includes an ignition circuit operable to produce a normally timed spark in the sparking device to normally combust the fuel, and an advanced timed sparking voltage to prematurely combust the fuel. A deadman mechanism is operable to actuate a decoupler to decouple one of the spark producers from the ignition circuit wherein the other of the spark producers is operable to generate the sparking voltage. The deadman mechanism is normally biased into a first position wherein the decoupler decouples the normally timed sparking voltage producer from the ignition circuit whereby the engine is inoperable. The deadman mechanism is operator actuable into a second position wherein the decoupler decouples the advanced timed sparking voltage producer from the ignition circuit whereby the engine is operable.

In one form thereof, the present invention comprises a magnet disposed on the flywheel, and a solid state flux gradient outwardly from the flywheel, and a solid state circuit for producing a sparking voltage in the spark plug including a first coil adapted to provide engine running voltage and a second coil adapted to provide engine stopping voltage. The first coil is radially disposed adjacent the flywheel and responsive to the magnetic flux by generating energy for the production of the sparking voltage when the piston is approximately 0° (at top dead center), for example, to thereby run the engine. The second coil is radially disposed adjacent the flywheel angularly displaced from the first coil and responsive to the magnetic flux by generating energy for the production of the sparking voltage when the piston is approximately 110° BTDC, for example, to thereby stop the engine. A deadman lever alternatively decouples one of the first and second coils from the circuit wherein the other coil is operative to generate the sparking voltage. The deadman lever is normally biased into a first position whereby the first coil is decoupled, and is operator actuable into a second position whereby the second coil is decoupled.

Other timing relationships are possible within one embodiment of the present invention such that braking of the piston is accomplished by the "controlled backfire" according to the present invention.

It is thus an advantage of the present invention that fewer parts are necessary over conventional flywheel brake systems, in that only a single switching mechanism is employed along with an extra induction coil.

It is another advantage of the present invention that no adjustments are required past initial installation.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1:
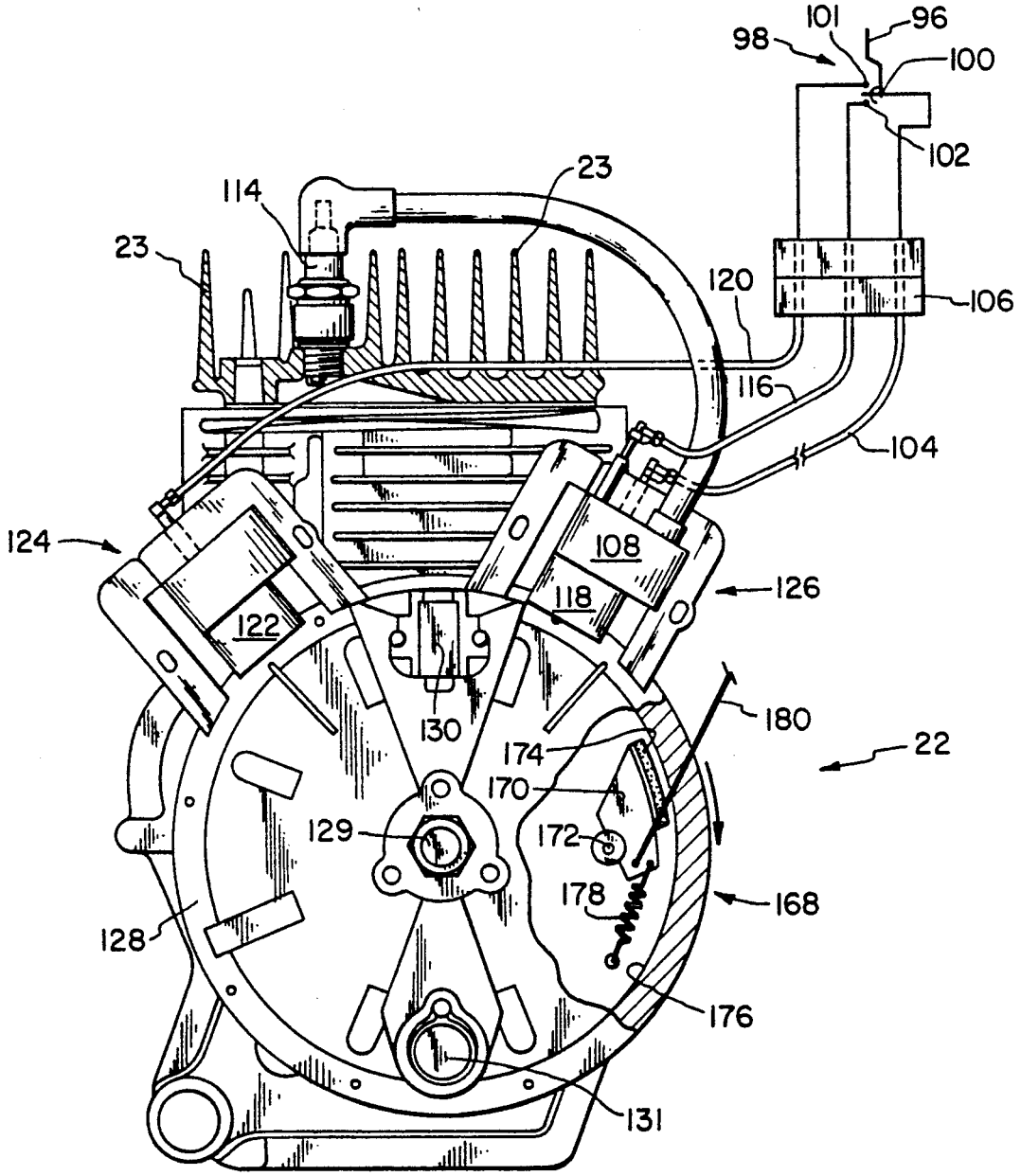
FIG. 1 is a front elevational view of a typical single cylinder internal combustion engine, with flywheel cover removed, incorporating an electronic ignition embodiment of the present invention.

Corresponding reference characters indicate corresponding parts throughout the several views. The exemplifications set out herein illustrate a preferred embodiment of the invention, in one form thereof, and such exemplifications are not to be construed as limiting the scope of the invention in any manner.

DESCRIPTION OF THE PREFERRED EMBODIMENT

Figure 2:
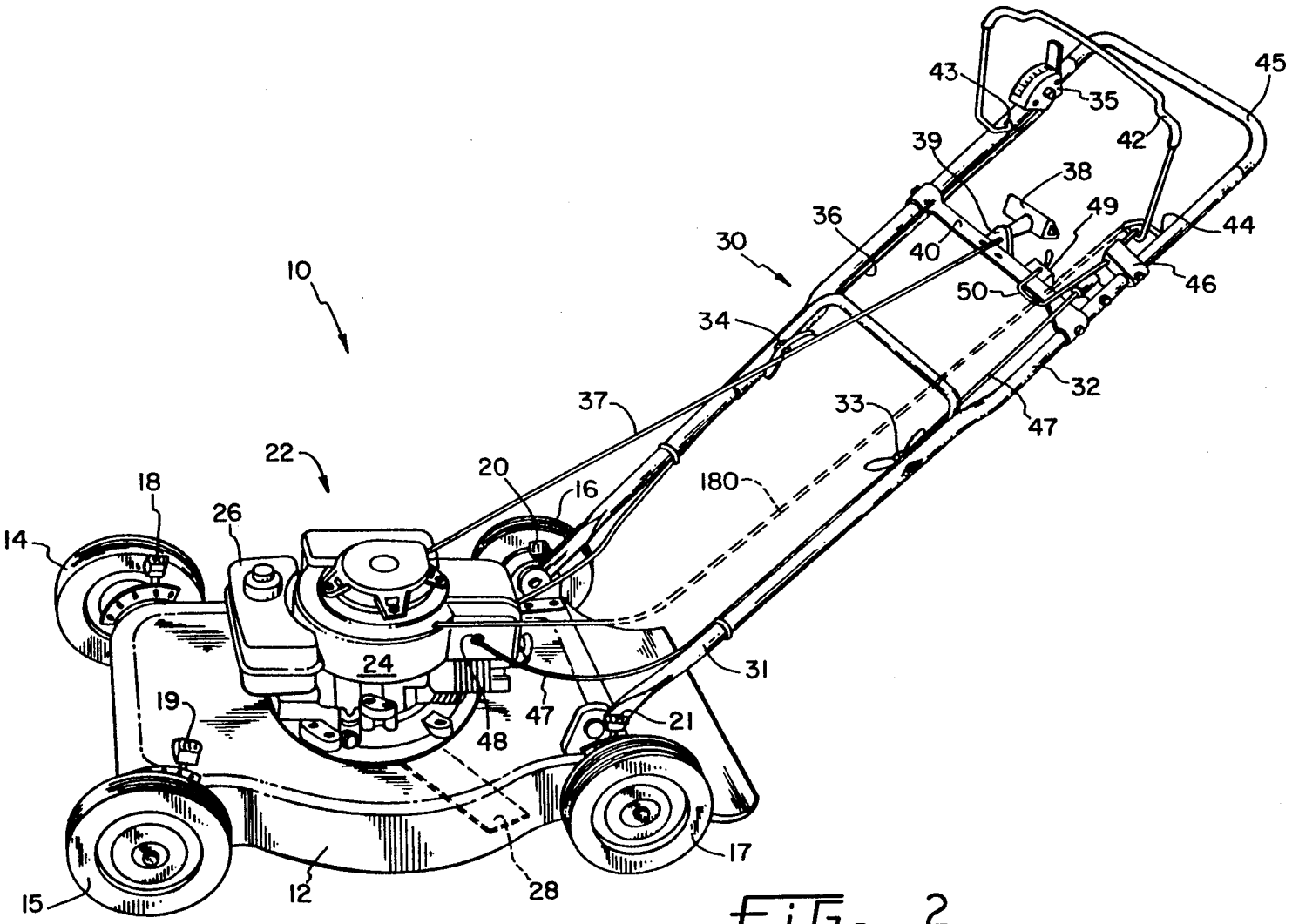
FIG. 2 is a perspective view of a typical lawn mower having a single cylinder internal combustion engine incorporating the present invention.

Referring now to FIG. 2, there is shown a typical walk behind lawn mower 10 which includes a deck 12. The invention is also applicable to riding lawn mowers, tractors, and other implements. Rotatably attached to deck 12 is a pair of front wheels 14, 15 and a pair of rear wheels 16, 17 each having a respective height adjustment mechanism 18, 19, 20, and 21. Centrally disposed on and supported by deck 12 is a single cylinder internal combustion engine 22 which includes a housing 24 and gasoline tank 26. Disposed beneath deck 12 and connected to the engine crankshaft (not shown) is a blade 28 (partially shown) for cutting grass. Connected to the sides at one end of deck 12 is a handle 30 which extends essentially outwardly from deck 12. Handle 30 consists of two sections, a lower handle section 31 and an upper handle section 32 joined together by wing nut and bolt combinations 33, 34 approximately midway of the total length of handle 30. Handle 30 is used to push and/or guide the lawn mower and is used as a support for various controls, described hereinbelow, which need to be accessible to the operator.

Attached to one side of upper handle section 32 is a throttle control mechanism 35 from which extends a throttle cable 36 that is generally a sheathed cable or Bowden cable. Throttle cable 36 is connected to the engine carburetor (not shown) such that movement of throttle control mechanism 35 causes the engine speed to change. Generally included on typical throttle mechanisms is a choke position used when starting the engine. A start/pull rope 37 is indirectly connected to the engine flywheel (not shown in FIG. 2) and has a pull handle 38 retained against a stop 39 on lower handle section cross-member 40. Also attached to upper handle section 32 is a deadman control lever 42 which is pivotally attached to both sides of upper handle section 32 at 43 and 44.

Deadman control lever 42 is shown in FIG. 2 in an engine stop position which is away from upper handle cross-member 45. When deadman control lever 42 is pivoted such that it rests against upper handle cross-member 45, the engine is in a run position. The engine run position of deadman control lever 42 is only attainable when there is a positive force retaining lever 42 against upper handle cross-member 45, as lever 42 is normally biased into an engine stop position. The positive retaining force necessary to overcome the normal biasing of lever 42 into the stop position is exerted as the operator physically holds lever 42 against upper handle cross-member 45, such as when the operator is mowing the lawn and thus pushing the mower by handle 30. The selective switching between the stop and run modes of the engine is controlled by a switch 46 mounted on upper handle section 33 and actuated by deadman control lever 42, the details of which are described hereinbelow with reference to the other Figures. A multiple wire lead 47 (described hereinbelow) extends from switch 46 and into engine 22 at 48. Additionally, an optional, manually controlled stop switch 49 (described hereinbelow) is mounted on cross-member 40 and is connected to switch 46 by a multiple wire lead 50.

Figure 3:
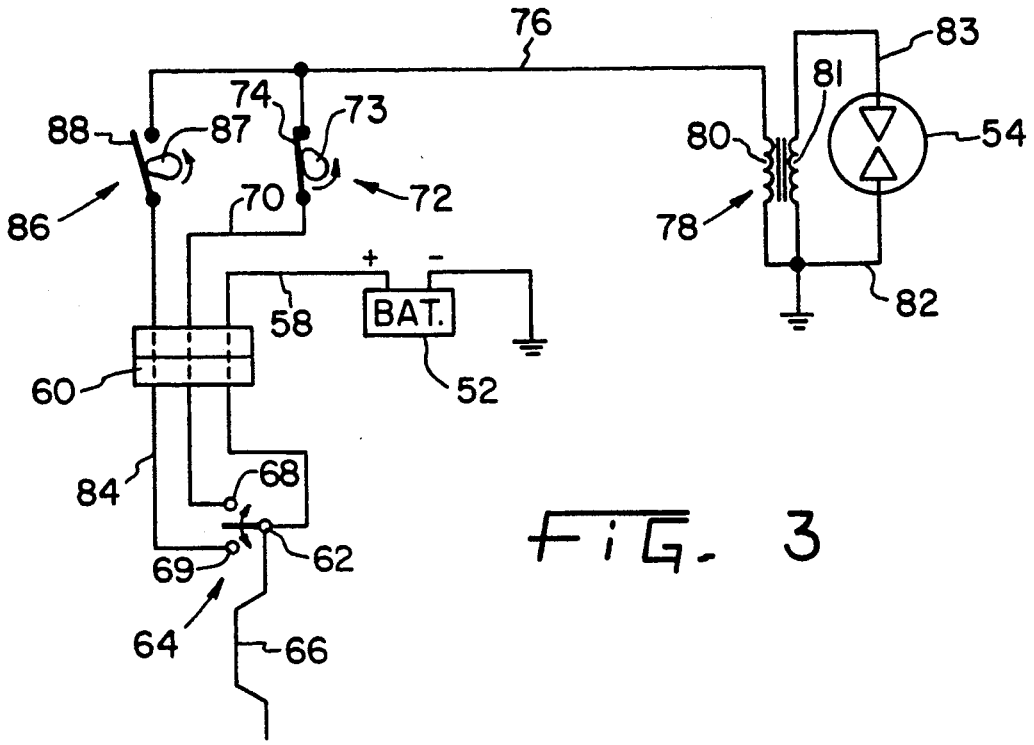
FIG. 3 is a schematic diagram of a mechanical ignition embodiment of the present invention utilizing a deadman controlled switch.

In accordance with the present invention, and referring to FIG. 3, there is shown a schematic diagram of a mechanical embodiment thereof. A battery or magneto-rectifier 52 supplies DC power for producing a spark in spark plug 54 which ignites the fuel mixture in the combustion chamber of the engine cylinder (not shown) in order for the engine to run. One terminal (−) of battery 52 is connected to ground (+) via wire 56, while the other terminal (+) of battery 52 via wire 58 through a connector 60 and to a terminal 62 of a control switch 64 (corresponding to switch 46 in FIG. 2) herein shown as a Single-Pole Double-Throw (SPDT) switch, but which could be any type of switchable device which permits selective switchability between two positions. It should be noted that any SPDT switch described, mentioned, or shown in the instant specification may be any type of switchable device as above described. SPDT control switch 64 is actuated by deadman control lever 66 (corresponding to deadman control lever 42 in FIG. 2) into either one of two positions, indicated by the double-headed arrow, depending on the position (stop or run) of deadman control lever 66 by contact with terminal 68 or 69. During the run position, deadman control lever 66 actuates switch 64 to contact terminal 62 with terminal 68 which is connected to wire 70 through contactor 60, with wire 70 connected to running breaker points 72. In this state switch 64 does not contact terminal 69 and thus stopping breaker points 86 are open circuited. Running breaker points 72 consists of a cam with follower 73 which intermittently opens and closes a running breaker switch arm 74 thereby intermittently connecting wire 70 with wire 76. Wire 76 is connected to an ignition transformer 78 consisting of a primary coil 80 and a secondary coil 81. Wire 76 is thus connected to one end of primary coil 80, while the other end of primary coil 80 is connected to ground (+) and wire 82. One end of secondary coil 81 is connected to ground (+) and wire 82, while the other end is connected to wire 83. Wire 82 and wire 83 connect to either ends of a spark plug 54.

In the stop position, deadman control lever 66 causes switch 64 to contact terminal 69 which is connected to wire 84 through contactor 60, with wire 84 connected to stop breaker points 72. In this state, switch 64 does not contact terminal 68 and thus running breaker points 72 are open circuited. Stop breaker points 86 consists of a cam with follower 87 which intermittently opens and closes a stop breaker arm 88 thereby intermittently connecting wire 84 with wire 76. Wire 76 is connected as described hereinabove.

The circuit of FIG. 3 operates as follows. During starting and running of the engine, deadman control lever 66 is in a run position whereby terminal 62 of switch 64 is contacting terminal 68 and terminal 69 is open circuited therefrom. Thus, current from battery 52 flows through wire 58, into switch 64 and wire 70. The current then intermittently flows into wire 76 when switch 74 is opened and closed by action of running breaker points 72. The on/off current flow into ignition transformer 78 creates a changing magnetic flux about primary coil 80 due to the changing current which induces a voltage in secondary coil 82. Secondary coil 82 is at a higher voltage than primary coil 80 so that a sparking voltage is created to fire spark plug 54. Run points 72 is timed to engine rotation such that the opening and closing of breaker arm 74 causes the current to create a spark in spark plug 54 when the engine piston (not shown) is at the top of its compression stroke in the combustion chamber of the cylinder (not shown) which is the conventional operating mode of internal combustion engines.

When switch 64 is actuated into a stop position through the releasing action of deadman control lever 66, terminal 62 is connected with terminal 69 and the current flowing from battery 52 flows into wire 84. Since deadman control lever 66 is normally biased in a stop position, once lever 66 is released, the transition from the run to stop position occurs rapidly. At this point the current into ignition transformer 78 is controlled by stop breaker points 86, the run points 72 being open circuited. The timing of stop cam 87 and stop breaker arm 88 is such that the spark occurs in spark plug 54 when the piston is 110° BTDC (Before Top Dead Center), for example, thereby producing a premature pressure rise in the combustion chamber forcing the piston downward against the inertia of the engine crankshaft to thereby stop the engine. Alternatively stated, this effectively causes the piston to push the crankshaft in a direction reverse to the forward motion, thereby stopping the engine. Given the high rotation velocity of the engine, the spark occurs almost immediately following the switch over to the stop breaker points 86.

Figure 4:
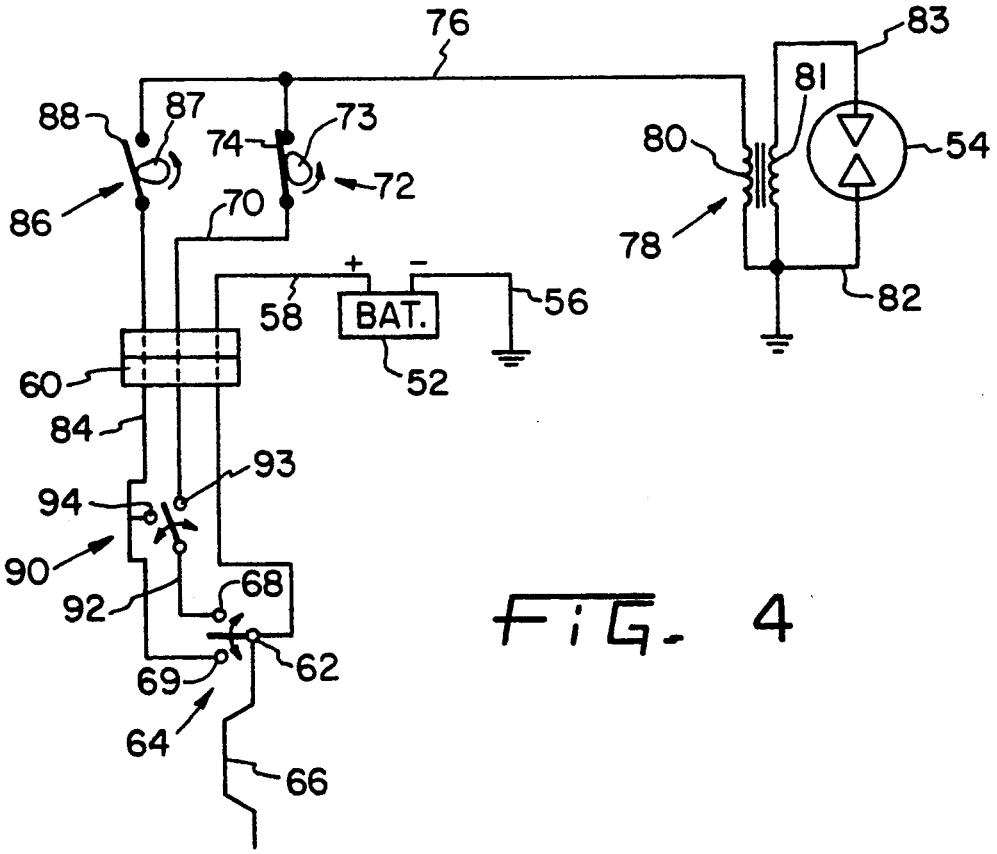
FIG. 4 is a schematic diagram of another mechanical ignition embodiment of the present invention utilizing a deadman controlled switch along with a separate operator actuated stop switch.

Referring now to FIG. 4, there is shown an embodiment identical to the embodiment of FIG. 3 with the addition of a on/off switch 90 (corresponding to switch 49 of FIG. 2) herein shown as a Single-Pole Double-Throw (SPDT) switch, but which could be any type of switchable device, disposed in wire 70 between terminal 68 of switch 64 via wire 92 and run breaker points 72. Switch 90 includes a terminal 93 connected to wire 70 and a terminal 94 connected to wire 84 such that switch 90 is selectively switchable to either the engine run points 72 via wire 70 or the engine stop points 86 via wire 84. Switch 90 is manually operated in case the operator wishes to utilize the switch to stop the engine. Thus, switch 90 may be used as an engine on/off switch, with the on position being connected to wire 70 and the off position being connected to wire 84. With switch 90 in the off position, the engine will not start or cease running through the operation described hereinabove, if the engine is currently running. With switch 90 is in the on position, the engine will start or keep running provided the deadman control lever is or has been moved into the "on" position.

In operation, the circuit of FIG. 4 functions and performs in the same manner as FIG. 3 with regard to generating a run spark and a stop spark in spark plug 54. On/off switch 90 is in a run position when terminal 62 is contacted with terminal 93, but switches the current flow from switch 64 into wire 84 and thus the engine stop circuit when contacted with terminal 94. This occurs when the deadman control lever 66 is in a run position.

Figure 5:
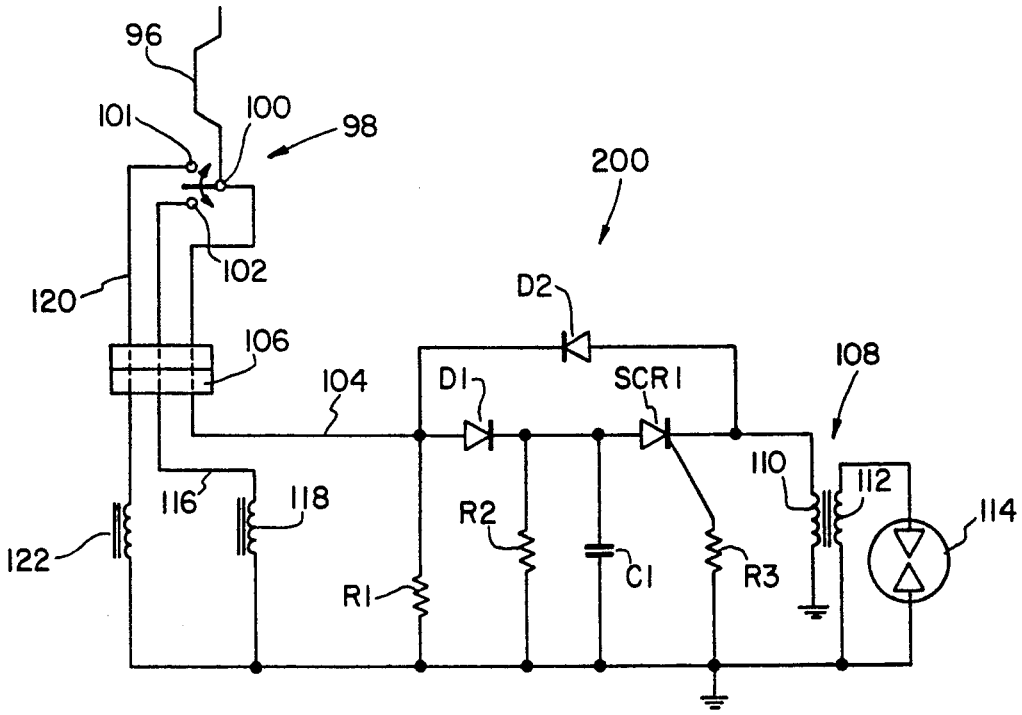
FIG. 5 is a schematic diagram of a solid state ignition embodiment of the present invention utilizing a deadman controlled switch.

Referring now to FIG. 5, there is shown another embodiment according to the present invention. FIG. 5 shows a schematic diagram of a solid state embodiment of the ignition brake as applied to a standard solid state capacitor discharge ignition circuit 200. A deadman control lever 96 (likewise corresponding to deadman control lever 42 of FIG. 2) is connected to a switch 98, herein shown as a Single-Pole Double-Throw (SPDT) switch but which could be any type of switchable device, at terminal 100. Deadman control lever 96 selectively determines which terminal 101, 102 the switch will contact as described hereinabove with reference to FIGS. 2–4. Wire 104 is connected to terminal 100, which passes into contactor 106 and is connected to the anode of diode D1. The cathode of diode D1 is connected with the anode of a Silicon Controlled Rectifier SCR1 while the cathode of SCR1 is connected to one end of primary coil 110 of ignition transformer 108. The other end of primary coil 110 is connected to ground (+), and is inductively coupled with a secondary coil 112 which has one end connected to ground (+). A spark plug 114 is connected across secondary coil 112 igniting the fuel mixture in the engine cylinder (not shown).

The circuit of FIG. 5 further includes a diode D2 with its anode connected to the cathode of SCR1 while the cathode of diode D2 is connected to the anode of diode D1. A resistor R1 is connected between the anode of diode D1 and ground (+), while a resistor R2 is connected at the node between the cathode of diode D1 and the anode of SCR1, and ground (+). A charging capacitor C1 is likewise connected between ground (+) and the node between the cathode of diode D1 and the anode of SCR1, while a resistor R3 is connected to the gate of SCR1 and ground (+).

Terminal 100 of switch 98 is selectably connectable terminal 101 or 102 depending on the position of deadman control lever 96 as described hereinabove. When switch 98 is actuated by deadman lever 96 such that terminal 100 contacts terminal 102, a run coil 118, having one end connected to ground (+), is switched into the circuit 200 through wire 116 connected to terminal 102 and one end of run coil 118 and stop coil 122 is open circuited. When switch 98 is actuated by deadman lever 96 such that terminal 100 contacts terminal 101, a stop coil 122, having one end connected to ground (+), is switched into the circuit 200 through wire 120 connected to terminal 101 and one end of stop coil 122 and run coil 118 is open circuited. It is evident that when either run coil 118 or stop coil 122 is switched into the circuit 200, the other coil is open circuited from the circuit 200.

In accordance with the present invention, the operation of the circuit of FIG. 5 will now be described with additional reference to FIG. 1. FIG. 1 shows engine 22 with a braking or stop lamination 124 which includes stop coil 122, and a run/ignition lamination 126 which includes run coil 118 and ignition transformer 108. A flywheel 128, attached on crankshaft 129, includes a magnet group 130 fixedly disposed on the periphery thereof. A counterweight 131 is also located on the periphery of flywheel 128 diametrically opposed to magnet group 130 in order to counterbalance the effects of the rotating weight. Magnet group 130 thus rotates with flywheel 128 in a direction shown by the arrow. Both laminations 124, 126 are fixedly positioned adjacent flywheel 128 such that magnet group 130 will pass in proximity to the laminations during each rotation. Brake lamination 124 is positioned about the periphery of flywheel 128 in spaced relationship to run lamination 126 such that magnet group 130 passes brake lamination 124 before run lamination 126. Brake lamination 124 is spaced a predetermined distance ahead of run lamination 126 corresponding to a point in time when a premature spark is to be developed. Thus, the timing of the braking spark depends on how far "ahead" brake lamination 124 is peripherally spaced from run lamination 126. The direction of flywheel rotation is indicated by the arrow. As magnet group 130 passes laminations 124, 126 the magnetic flux of the magnets will induce a current in the respective coils, 122 and 118. Depending on which coils 122, 118 are switched into and out of the circuit 200 by switch 98, controlled by deadman control lever 96 as hereinabove described, that coil will generate the charging current and discharging trigger current to create the sparking voltage for spark plug 114 as hereinbelow described. Regardless of which coil 118 or 122 is switched into and out of the circuit 200 and therefore generating the current for the ignition system, the operating principles are the same. One polarity of the magnetic flux induces a current to flow in the respective coil 118 or 122 creating a one-half cycle of current in a direction so as to charge capacitor C1. The current induced during the respective one-half cycle flows through diode D1 and charge capacitor C1, as SCR1 will not allow current to flow until a bias current is present at the gate of SCR1 through resistor R3. As soon as capacitor C1 is fully charged, the other polarity of magnetic flux passes by the respective coil 118 or 122 inducing a current of opposite direction to flow in the circuit. This is the trigger current which biases the gate of SCR1 to allow current to flow from the anode to the cathode of SCR1. Since capacitor C1 is charged and diode D1 blocks a circuit path from which to discharge, the conductivity of SCR1 during the trigger current half-cycle permits discharge of capacitor C1 through primary 110 of ignition transformer 108. This creates a higher voltage current in secondary 112 thereby creating a spark in spark plug 114 to ignite the fuel mixture in the cylinder. This sequence repeats itself upon every rotation of flywheel 128. Resistors R1 and R2, and diode D2 serve to protect the circuit components and provide increased arc-duration.

As stated above, the operation of the circuit is the same regardless of which coil, run coil 118 or stop coil 122 is switched into the circuit. It is the timing of the spark created in spark plug 114 relative to the position of the piston (not shown) in the cylinder (not shown) by the respective coil which induces the braking action of the engine. As seen in FIG. 1, run/ignition lamination 126 is positioned adjacent flywheel 128 such that the spark created in spark plug 114 occurs when the piston (not shown) is at the top of its compression stroke. The maximum amount of power is achieved when the piston is at the top of its compression stroke. Thus, when deadman control lever 96 actuates switch 98 such that run coil 118 is present in the circuit, run coil 118 therefore generates the charging and discharging current for the spark plug 114.

However, when stop coil 122 is present in the circuit by action of deadman control lever 96 and switch 98, and thus run coil 118 is open circuited, the rotating magnet group 130 passes stop lamination 124 before the normal run charge and discharge current is formed by the coils of lamination 126. Stop lamination 124 with stops coil 122 is positioned above flywheel 128 such that is generates the charge and discharge trigger current for creation of the spark in spark plug 114 when the piston is 110° from BTDC for example. Thus, as the piston is on its upstroke towards the top of its compression stroke, a spark occurs in the cylinder driving the piston downward, counteracting the rotational motion of the crankshaft, thereby stopping the engine.

Figure 6:
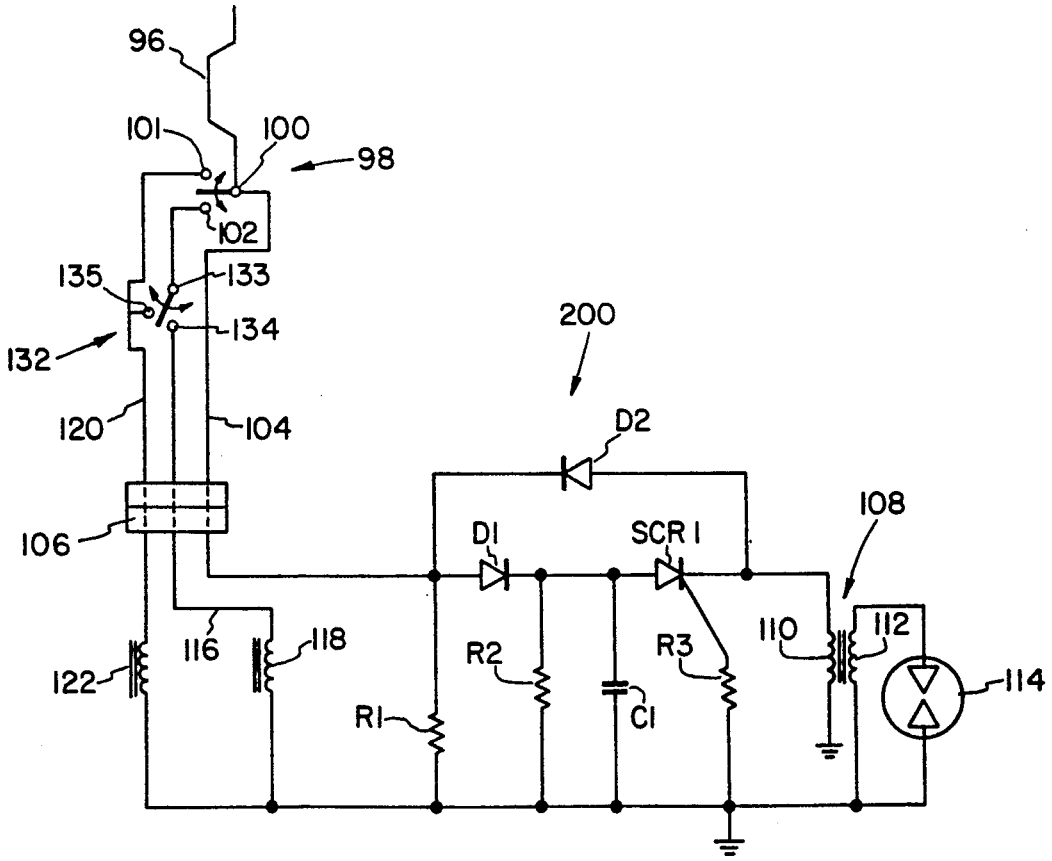
FIG. 6 is a schematic diagram of another solid state ignition embodiment of the present invention utilizing a deadman controlled switch along with a separate operator actuated stop switch.

Referring to FIG. 6, a SPDT start/stop switch 132 is disposed in wire 116. The circuit of FIG. 6 is identical in form, function, and operation as the circuit of FIG. 5 except for the addition of start/stop switch 132. In addition, the form, function, and operation of the deadman lever 136 is also as previously described. In operation, start/stop switch 132 operates the same as stop switch 90 in FIG. 4. Switch 132 is manually actuated by the operator such that when terminal 133 is connected with terminal 134, run coil 118 is present in the circuit, and stop coil 122 is open circuited therefrom. Thus, operation is controlled by run coil 118. When terminal 133 is connected with terminal 135, stop coil 122 is present in the circuit, and run coil 118 is open circuited therefrom. Thus operation is controlled by stop coil 122 to brake the engine upon one revolution of flywheel past lamination 124 as hereinabove described.

Figure 7:
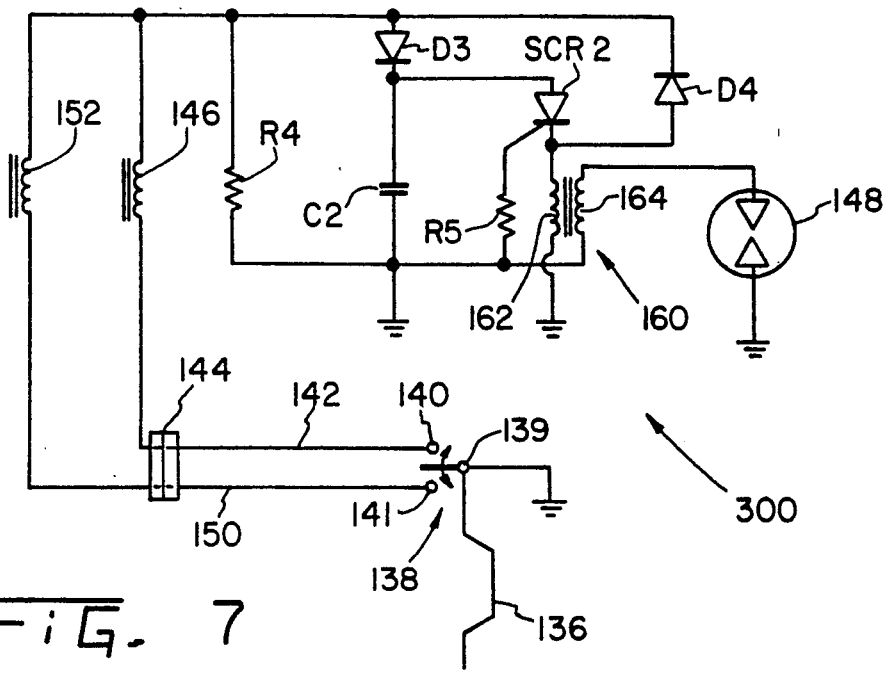
FIG. 7 is a schematic diagram of solid state ground to run embodiment of the present invention utilizing a deadman controlled switch.
Figure 8:
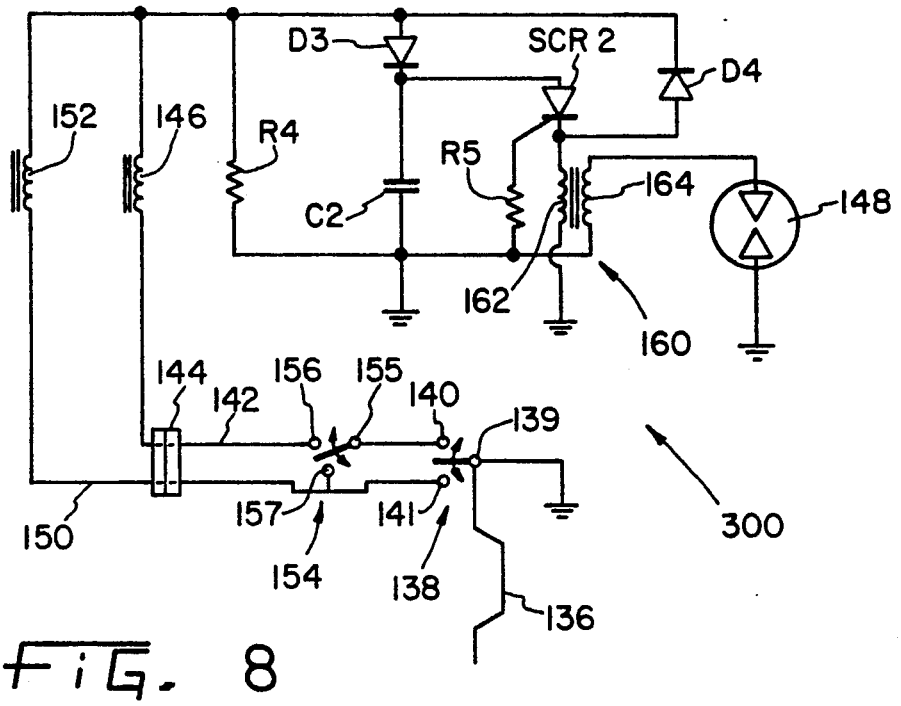
FIG. 8 is a schematic diagram of solid state ground to run embodiment of the present invention utilizing a deadman controlled switch along with a separate operator actuated stop switch.

Referring now to FIGS. 7 and 8, there is shown an alternative embodiment of the control circuit designated a ground to run circuit, in that only two leads are necessary rather than three since ground ( ) is used. It should be understood by the showing of various , that the present invention is not limited in applicability to a specific circuit embodiment. Rather, many types of circuits are possible and contemplated to be used with the present invention. A deadman lever 136, corresponding in form, function, and operation to all previous deadman levers, is connected to a SPDT switch 138. Switch 138 includes a switch terminal 139 connected to ground ( ), and terminals 140 and 141. Actuation of switch 138 by deadman lever 136 so as to connect terminal 139 with terminal 140, as described hereinabove with reference to the other FIGS., connects terminal 139 with wire 142. This connects run coil 146 into the circuit through wire 142 passing through connector 144. With run coil 146 in the circuit, a spark is created in spark plug 148 through action of the circuit, described hereinbelow, when the piston (not shown) is at the top of its compression stroke. Alternatively, actuation of switch 138 by deadman lever 136 so as to connect terminal 139 with terminal 141, as described hereinabove with reference to the other FIGS., connects terminal 139 with wire 150 passing through connector 144. Wire 150 is connected to stop coil 152. With stop coil 152 in the circuit, a spark is created in spark plug 148 through action of the circuit, described hereinbelow, when the piston (not shown) is at 110° BTDC to cause a braking of the engine. FIG. 8 shows an SPDT start/stop switch 154 disposed in wire 142 having terminal 155 connected with terminal 140 of switch 138 selectable between terminals 156 and 157. The same form, function, and operation of switches 90 (FIG. 4) and/or 132 (FIG. 6) applies to switch 154. Switch 154 is manually operable to selectively switch run coil 146 and stop coil 152 into the circuit regardless of the position of deadman lever 136.

In operation, the circuit of FIGS. 7 and 8 creates a spark analogous to the operation described with reference to FIGS. 5 and 6. During one-half cycle, capacitor C2 is charged with current induced by the magnet group in run coil 146 which flows through diode D3 since diode D4 blocks the incoming flow. Once capacitor C2 is charged, the opposite half-cycle enters the gate of SCR2, causing SCR2 to become conducting from its anode to its cathode, allowing capacitor C2 to discharge through SCR2 and into primary coil 162 of ignition transformer 160. This creates a changing magnetic flux inducing a current in secondary coil 164 thereby causing a spark to be produced in spark plug 148. Resistor R4 and diodes D3 and D4 also serve to protect the circuit and provide for greater arc-duration.

In addition to solid state capacitor discharge ignition circuits such as the SCR triggered capacitor discharge ignition circuit, other types of solid state ignition circuits may be utilized. One other type of solid state ignition circuit is an inductive ignition circuit such as that shown in FIG. 3 and described in U.S. Pat. No. 4,712,521 issued Dec. 15, 1987, entitled "IGNITION SYSTEM" being specifically incorporated herein by reference.

FIG. 3 of U.S. Pat. No. 4,712,521 utilizes a power transistor 60 and a control transistor 62 with a control coil 64 and two resistors 66, 68 to create a sparking voltage through primary and secondary coils 72, 76 for the spark gap 82. In accordance with the present invention, the inductive ignition circuit of FIG. 3 would include a second control coil disposed in parallel with control coil 64, with the deadman control switch connected between the two control coils in order to alternatively switch one of the control coils into circuit relationship while removing the other control coil from circuit relationship in the same manner as that described herein. With control coil 64 causing the creation of a normally timed sparking voltage, the second control coil would be spaced therefrom in order to cause the creation of an advanced timed sparking voltage when switched into circuit relationship by the deadman control switch. It should be noted that switch 78 in FIG. 3 of U.S. Pat. No. 4,712,521 can be eliminated from the circuit. The operation of the solid state inductive ignition circuit is as described in the specification of U.S. Pat. No. 4,712,521, while the operation of the switching of the control coils via the deadman control is accomplished in the same manner as that described herein.

Again with reference to FIGS. 1 and 2, the present system may be utilized along with a conventional flywheel brake shoe mechanism generally designated at 168. Brake shoe mechanism includes an arm 170 pivotable about pivot 172 on which is mounted as conventional brake pad 174. Brake pad 174 is normally biased to contact the inner periphery 176 of flywheel 128 by spring 178, thereby preventing rotation of flywheel 128. A cable 180 is attached to arm 170 and extends from engine 22 to deadman lever 42, such that deadman lever 42 is normally biased to stop rotation of flywheel 128. When deadman lever 42 is actuated by the operator, as described hereinabove, the opposite biasing pivots arm 170 and thus brake pad 174 away from inner flywheel periphery 176 to allow free rotation of flywheel 128. The flywheel brake shoe is described in more detail in U.S. Pat. Nos. 4,889,213 and 4,979,596 identified and incorporated by reference hereinabove. Alternatively, the brake could be actuated by the operator dismounting from a riding lawnmower.

Thus, a flywheel brake system as more fully described in the patents incorporated by reference can be used in conjunction with the ignition brake if so desired.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. In an internal combustion engine powered implement having an engine with a piston disposed in a cylinder, a crankshaft, a flywheel secured to the crankshaft, and a sparking device for igniting fuel in the cylinder, a safety device comprising:

an ignition circuit operable to produce a spark in the sparking device to combust the fuel, said ignition circuit having means for generating a normally timed sparking voltage to normally combust the fuel, and means for generating an advanced timed sparking voltage to prematurely combust the fuel;

a switch device for decoupling one of said generating means from said ignition circuit and connecting the other of said generating means in said ignition circuit; and a deadman mechanism operable to actuate said switch device, said deadman mechanism being operator actuable into a first position wherein said switch device decouples said means for generating an advanced timed sparking voltage from said ignition circuit whereby said engine may normally run, said deadman mechanism normally biased into a second position when released by the operator wherein said switch device decouples said means for generating a normally timed sparking voltage from said ignition circuit and connects said means for generating an advanced sparking voltage to cause the engine to rapidly slow and stop under influence of the prematurely combusted fuel.

2. The safety device of claim 1, wherein said means for generating a normally timed sparking voltage is a first breaker switch and a first rotating cam, said first rotating cam open circuiting said first breaker switch to generate said normally timed sparking voltage, and said means for generating an advanced timed sparking voltage is a second breaker switch and a second rotating cam rotating in advanced phase relative to said first cam, said second rotating cam open circuiting said second breaker switch to generate said advanced timed spar said first cam open circuits said first breaker switch.

3. The safety device of claim 2, wherein said switch device alternatively connects one of said first breaker and said second breaker switch in said ignition circuit an disconnects the other of said first breaker switch and said second breaker switch when actuated by the deadman mechanism.

4. The safety device of claim 1, wherein said ignition circuit further comprises a magnet disposed on the flywheel so as to rotate therewith, said magnet producing a magnetic flux gradient about the flywheel;

said means for generating a normally timed sparking voltage is a first coil disposed about the periphery of the flywheel and responsive to said magnetic flux, said means for generating an advanced sparking voltage is a second coil disposed about the periphery of the flywheel and responsive to said magnetic flux, said second coil being circumferentially spaced from said first coil such that said magnet passes said second coil before said first coil.

5. The safety device of claim 4, wherein said first coil is disposed about the periphery of the flywheel to generate a sparking voltage when the piston is approximately 0° BTDC, and said second coil is disposed about the periphery of the flywheel to generate an advance sparking voltage when the piston is approximately 110° BTDC.

6. The safety device of claim 4, wherein said switch device alternatively connects one of said first coil and said second coil in said ignition circuit and disconnects the other of said first coil and said second coil when actuated by the deadman mechanism.

7. The safety device of claim 1, including a mechanical blade brake that is actuated when said deadman mechanism is released.

8. In an internal combustion engine powered implement having an engine with a piston disposed in a cylinder, a crankshaft, a flywheel secured to the crankshaft, a magnet disposed on the flywheel so as to rotate therewith, the magnet producing a magnetic flux gradient about the flywheel, and a sparking device for igniting fuel in the cylinder, a safety device comprising:

an ignition circuit operable to produce a spark in the sparking device to combust the fuel, said ignition circuit including a first coil disposed about the periphery of the flywheel and responsive to the magnetic flux generated by the magnet, said first coil for generating a normally timed sparking voltage to normally combust the fuel, and a second coil disposed about the periphery of the flywheel and responsive to the magnetic flux generated by the magnet, said second coil for generating an advanced timed sparking voltage to prematurely combust the fuel;

a switch device for decoupling one of said coils from said ignition circuit and connecting the other of said coils in said ignition circuit; and a deadman mechanism operable to actuate said switch device, said deadman mechanism being operator actuable into a first position wherein said switch device decouples said second coil from said ignition circuit whereby said engine may normally run, said deadman mechanism normally biased into a second position when released by the operator wherein said switch device decouples said first coil from said ignition circuit and connects said second coil to cause the engine to rapidly slow and stop under influence of the prematurely combusted fuel.

9. The safety device of claim 8, wherein said first coil is disposed about the periphery of the flywheel so as to generate a sparking voltage upon passage of said magnet when the piston is approximately 0° BTDC, and said second coil is disposed about the periphery of the flywheel and circumferentially spaced from said first coil so as to generate an advanced sparking voltage upon passage of said magnet when the piston is approximately 110. BTDC.

10. The safety device of claim 8, including a mechanical blade brake that is actuated when said deadman mechanism is released.

11. In a lawnmower having wheels and a handle gripped by an operator, the lawnmower powered by a single cylinder internal combustion engine having a piston disposed in the cylinder, a crankshaft, a flywheel disposed on one end of the crankshaft, a blade disposed on another end of the crankshaft, a magnet disposed on the flywheel, the magnet producing a magnetic flux gradient from the flywheel, and a spark plug for igniting fuel in the cylinder, a safety device for stopping the engine, the safety device comprising:

a solid state ignition circuit for producing a spark in the spark plug to combust the fuel, said ignition circuit including a first coil disposed about the periphery of the flywheel and responsive to the magnetic flux as said magnet passe thereby to produce a normally timed sparking voltage for said ignition circuit, and a second coil disposed about the periphery of the flywheel angularly spaced from said first coil and responsive to the magnetic flux as said magnet passes thereby to produce an advanced timed sparking voltage for said ignition circuit to prematurely combust the fuel;

a switch device for decoupling one of said coils from said ignition circuit and connecting the other one of said coils in said ignition circuit; and a deadman lever pivotally attached to the handle so as to be gripped by an operator during operation of the lawnmower and operable to actuate said switch device, said deadman lever being operator biased during gripping of the handle into first position wherein said switch device decouples with second coil from said ignition circuit whereby the engine may normally run, said deadman lever normally biased into a second position when released by the operator wherein said switch device decouples said first coil from said ignition circuit and connects said second coil to cause the engine to rapidly slow and stop itself and the blade under influence of the prematurely combusted fuel.

12. The safety device of claim 11, wherein said first coil is disposed about the periphery of the flywheel so as to generate a sparking voltage upon passage of said magnet when the piston is approximately 0° BTDC, and said second coil is disposed about the periphery of the flywheel and circumferentially spaced from said first coil so as to generate an advanced sparking voltage upon passage of said magnet when the piston is approximately 110° BTDC.

13. The safety device of claim 11, including a mechanical blade brake that is actuated when the deadman lever is released.

14. The safety device of claim 11, wherein said lawnmower is a walk behind lawnmower.

* * * * *